US010641286B2

(12) United States Patent
Wang

(10) Patent No.: US 10,641,286 B2
(45) Date of Patent: May 5, 2020

(54) WATERPROOF STRUCTURE OF WALL-MOUNTED FAN HOUSING

(71) Applicant: AIR COOL INDUSTRIAL CO., LTD., Taichung (TW)

(72) Inventor: Cliff Wang, Taichung (TW)

(73) Assignee: AIR COOL INDUSTRIAL CO., LTD., Taichung (TW)

( * ) Notice: Subject to any disclaimer, the term of this patent is extended or adjusted under 35 U.S.C. 154(b) by 312 days.

(21) Appl. No.: 15/806,177

(22) Filed: Nov. 7, 2017

(65) Prior Publication Data

US 2019/0136870 A1 May 9, 2019

(51) Int. Cl.

| | |
|---|---|
| ***F04D 29/52*** | (2006.01) |
| ***F04D 29/70*** | (2006.01) |
| ***F04D 25/08*** | (2006.01) |
| ***F04D 25/10*** | (2006.01) |

(52) U.S. Cl.

CPC ..... *F04D 29/522* (2013.01); *F04D 25/08* (2013.01); *F04D 25/088* (2013.01); *F04D 25/105* (2013.01); *F04D 29/701* (2013.01)

(58) Field of Classification Search

CPC ..... F04D 29/522; F04D 29/701; F04D 25/08; F04D 25/088; F04D 25/105; H02K 5/10

See application file for complete search history.

(56) References Cited

U.S. PATENT DOCUMENTS

| | | | | |
|---|---|---|---|---|
| 2,357,053 | A * | 8/1944 | Moeller | F04D 25/105 310/40.5 |
| 3,228,260 | A * | 1/1966 | Braskamp | F04D 25/105 74/600 |
| 5,458,462 | A * | 10/1995 | Shao | F04D 25/105 416/100 |
| 5,556,256 | A * | 9/1996 | Shao | F04D 25/105 403/141 |
| 5,929,544 | A * | 7/1999 | Maekawa | F04D 25/06 310/62 |
| 6,468,036 | B1 * | 10/2002 | Song | F01D 7/00 416/100 |
| 7,594,798 | B1 * | 9/2009 | Bucher | F04D 25/105 415/121.2 |
| 2015/0084460 | A1 * | 3/2015 | Shiraishi | H02K 13/006 310/71 |

FOREIGN PATENT DOCUMENTS

JP H01101145 U * 7/1989

* cited by examiner

*Primary Examiner* — Justin D Seabe
*Assistant Examiner* — Jesse M Prager
(74) *Attorney, Agent, or Firm* — Sinorica, LLC

(57) ABSTRACT

A waterproof structure of a wall-mounted fan housing includes a housing. One side of the main housing is fitted on the outer wall of a first secondary opening of the secondary housing. The housing and the accommodation space of the housing are inclined downward from the main housing toward the secondary housing, preventing rainwater from entering the housing. Another side of the secondary housing has a second secondary opening. The housing is provided with a first drain hole and a motor therein. The first drain hole is disposed at the bottom of the housing close to the second secondary opening of the secondary housing so that rainwater can be discharged from the first drain hole.

15 Claims, 10 Drawing Sheets

WATERPROOF STRUCTURE OF WALL-MOUNTED FAN HOUSING

FIELD OF THE INVENTION

The present invention relates to a wall-mounted fan, and more particularly, to a waterproof structure of a wall-mounted fan housing.

BACKGROUND OF THE INVENTION

FIG. 1 is a schematic view of a waterproof structure of a conventional ceiling fan when in use. The ceiling fan comprises a seat body 1 and a first sealing ring 2. The first sealing ring 1 covers the top and the peripheral side of the seat body 1. The seat body 1 and the first seal ring 2 are locked to the ceiling. The seat body 1 is connected with a motor housing 4 through a support rod 3. The support rod 3 is connected with an adapter 5. A second sealing ring 6 is provided and locked between the adapter 5 and the motor housing 4. The first sealing ring 2 and the second sealing ring 6 are made of a soft, plastic or rubber material. Through the first sealing ring 2 and the second seal ring 6, the ceiling fan achieves fastening and waterproof effects between the seat body 1 and the ceiling and between the motor housing 4 and the adapter 5.

After the ceiling fan is installed, the user won't regularly check the deterioration of the sealing rings of the ceiling fan. When the first sealing ring 2 and the second sealing ring 6 are used for a long time and are not periodically replaced, the first sealing ring 2 and the second sealing ring 6 may be deteriorated and damaged. As a result, the waterproof function of the ceiling fan is ineffective, and rainwater accumulates in the motor housing. If the first sealing ring 2 and the second sealing ring 6 are damaged, a gap will be generated between the adapter 5 and the motor housing 4. When the ceiling fan is running, the adapter 5 and the motor housing 4 may shake, collide with or disengage from each other to cause a danger. Accordingly, the inventor of the present invention has devoted himself based on his many years of practical experiences to solve these problems.

SUMMARY OF THE INVENTION

The primary object of the present invention is to provide a waterproof structure of a wall-mounted fan housing, which can be used for outdoor waterproofing without the use of a sealing ring. The housing has waterproof and drainage functions to prevent water from accumulating in the housing and can be assembled more easily.

In order to achieve the aforesaid object, the waterproof structure of the wall-mounted fan housing of the present invention comprises a housing, a motor, and a first drain hole. The housing has an accommodation space therein. The housing has a main housing and a secondary housing. One side of the main housing has a main opening. The main housing has a connecting portion around a periphery of the main opening. One side of the secondary housing has a first secondary opening. The connecting portion of the main housing is fitted on an outer wall of the first secondary opening of the secondary housing. Respective insides of the main housing and the secondary housing jointly form the accommodation space. The housing and the accommodation space of the housing are inclined downward from the main housing toward the secondary housing. Another side of the secondary housing has a second secondary opening. The motor is disposed in the accommodation space of the housing. A rotating shaft of the motor extends toward the second secondary opening of the secondary housing. The first drain hole is disposed at a bottom of the secondary housing close to the second secondary opening of the secondary housing. The first drain hole is lower than the motor.

When it is raining, because the connecting portion of the main housing is fitted on the outer wall of the secondary housing and the housing and the accommodation space of the housing are inclined downward from the main housing toward the secondary housing, rainwater won't enter the accommodation space of the housing from the gap between the main housing and the secondary housing. If rainwater enters the accommodation space of the housing from the second secondary opening of the secondary housing, the rainwater can be discharged from the first drain hole. Because the first drain hole is lower than the motor, the rainwater does not accumulate to the motor.

DETAILED DESCRIPTION OF THE PREFERRED EMBODIMENTS

Embodiments of the present invention will now be described, by way of example only, with reference to the accompanying drawings.

Figure 1:
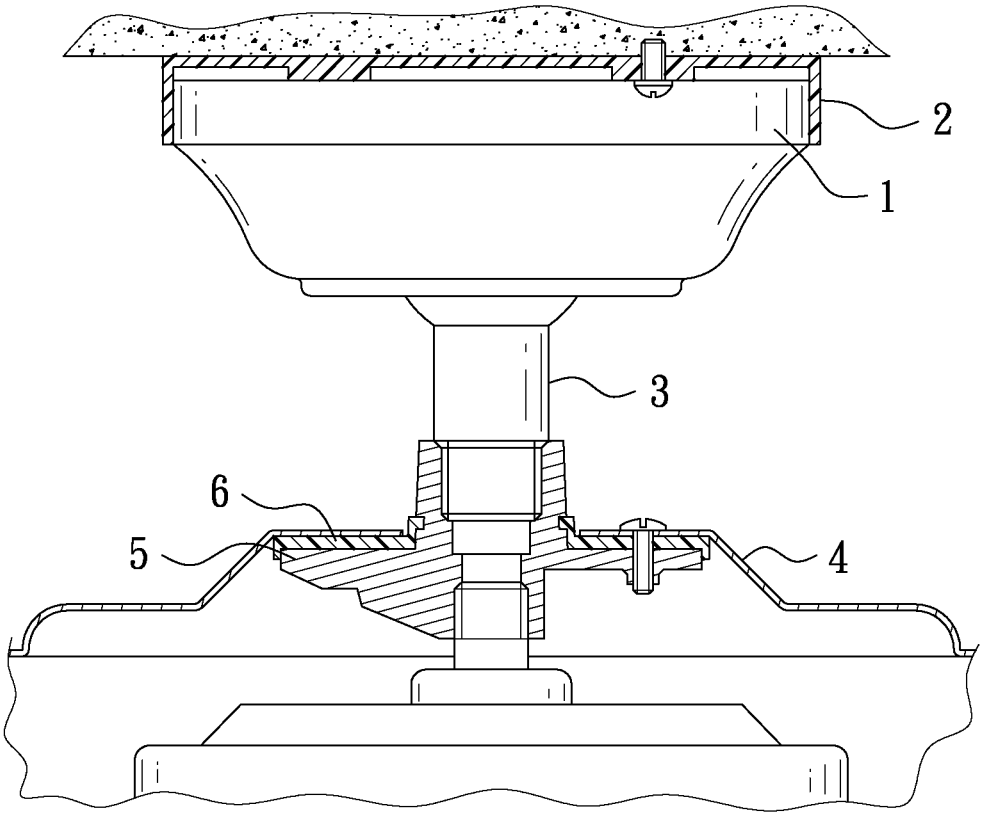
FIG. 1 is a schematic view of the waterproof structure of a conventional ceiling fan when in use.
Figure 2:
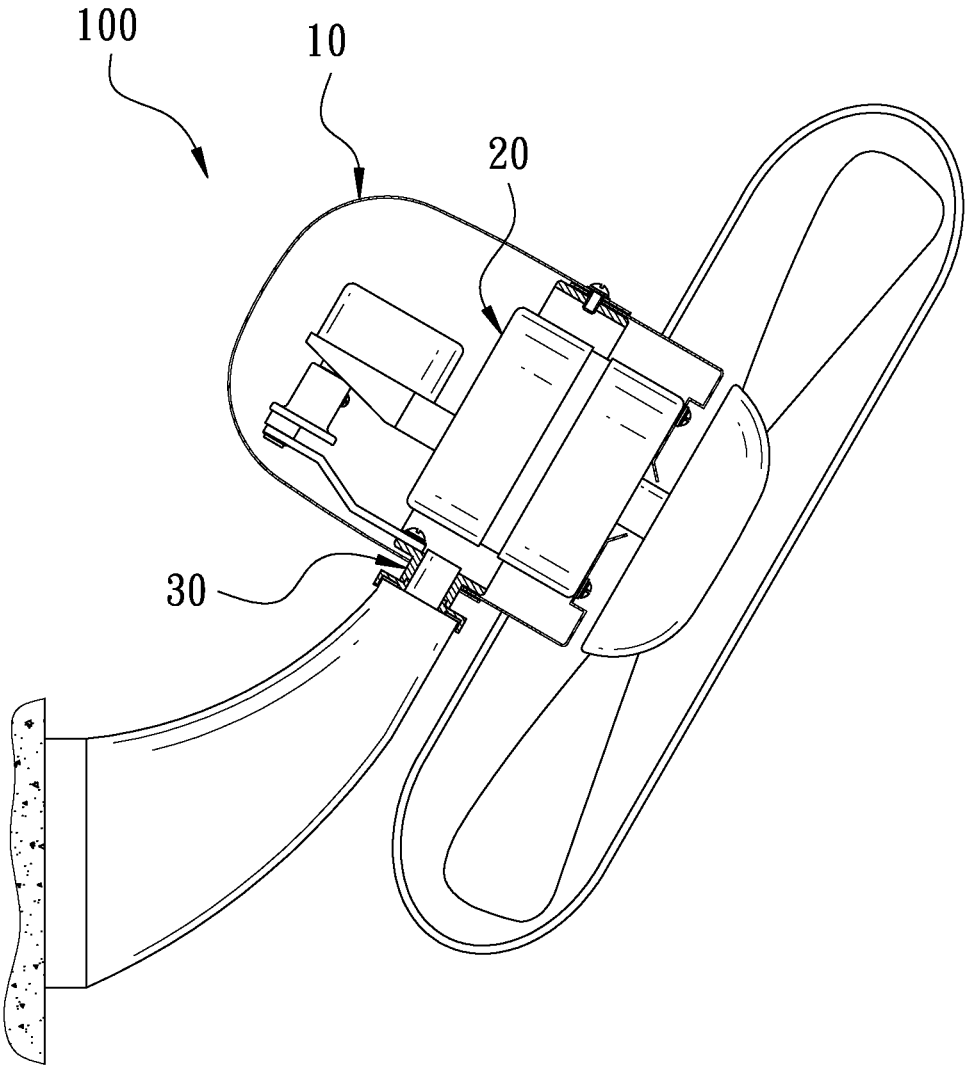
FIG. 2 is a schematic view in accordance with a first embodiment of the present invention when in use.
Figure 3:
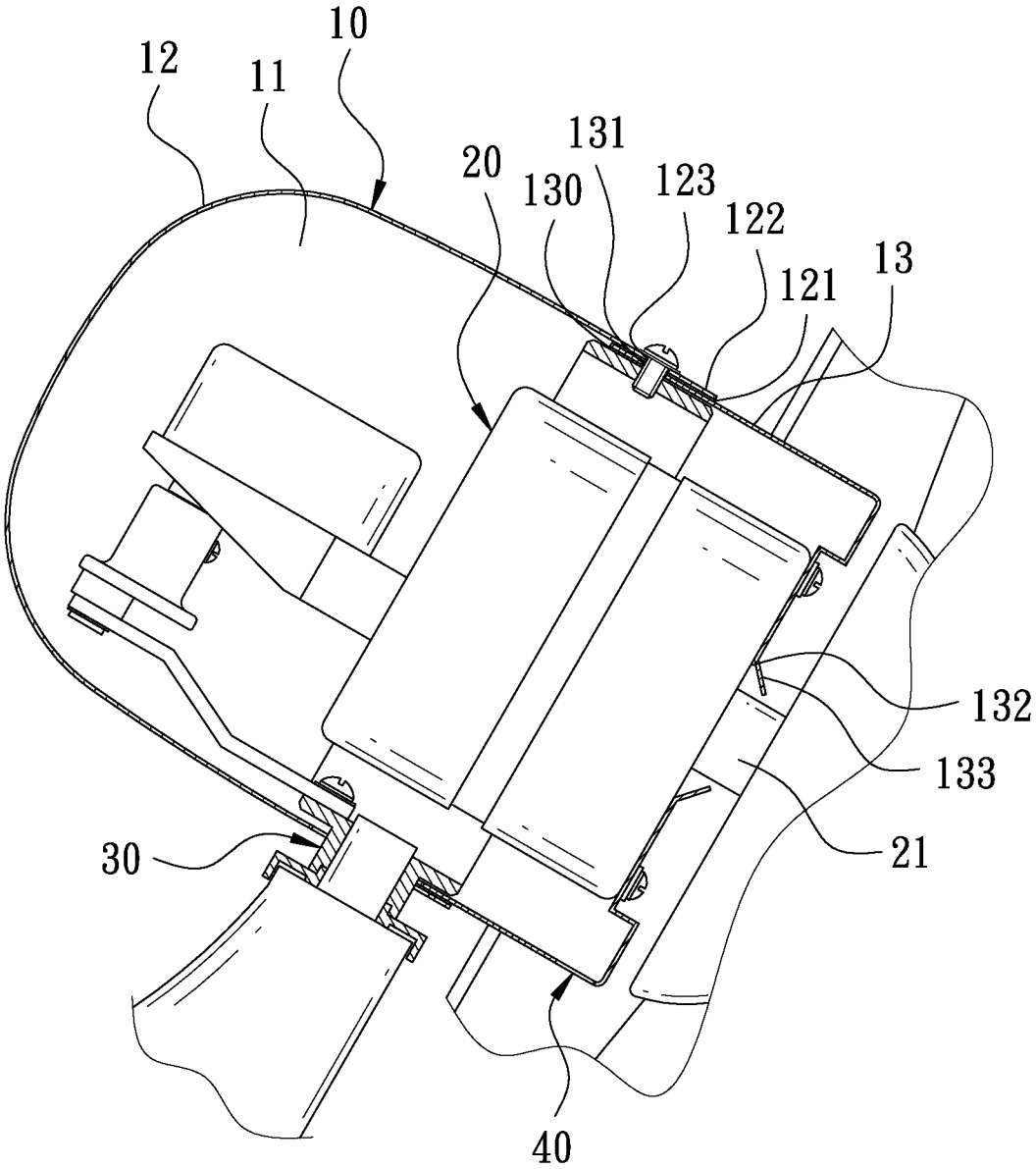
FIG. 3 is another schematic view in accordance with the first embodiment of the present invention when in use.

FIG. 2 and FIG. 3 are schematic views in accordance with a first embodiment of the present invention when in use. The present invention discloses a waterproof structure 100 of a wall-mounted fan housing. The waterproof structure 100 of the wall-mounted fan housing comprises a housing 10, a motor 20, a support rod 30, and a first drain hole 40.

The housing 10 has an accommodation space 11 therein. The housing 10 has a main housing 12 and a secondary housing 13. One side of the main housing 12 has a main opening 121. The main housing 12 has a connecting portion 122 around the periphery of the main opening 121. One side of the secondary housing 13 has a first secondary opening 130. The connecting portion 122 of the main housing 12 is fitted on the outer wall of the first secondary opening 130 of the secondary housing 13. The connecting portion 122 of the main housing 12 is provided with a screw hole 123. The secondary housing 13 is provided with a locking hole 131 corresponding to the screw hole 123 for locking. The respective insides of the main housing 12 and the secondary housing 13 jointly form the accommodation space 11. The housing 10 and the accommodation space 11 of the housing 10 are inclined downward from the main housing 12 toward the secondary housing 13. Another side of the secondary housing 13 has a second secondary opening 132. The outer wall of the secondary housing 13, adjacent to the second secondary opening 132, is provided with an extension portion 133 around the second secondary opening 132. The extension portion 133 is tapered outwardly to prevent infiltration of rainwater. The housing 10 is made of a sealing waterproof material. In an embodiment of the present invention, the housing 10 has a circular curve shape.

The motor 20 is disposed in the accommodation space 11 of the housing 10. The motor 20 has a rotating shaft 21. The rotating shaft 21 extends toward the second secondary opening 132 of the secondary housing 13. The motor 20 is spaced a distance from the inner wall of the housing 10.

The support rod 30 is disposed at the bottom of the housing 10. The support rod 30 penetrates through the main housing 12 and the secondary housing 13. The support rod 30 is located under the motor 20.

The first drain hole 40 is disposed at the bottom of the secondary housing 13 close to the second secondary opening 132 of the secondary housing 13. The position of the first drain hole 40 is lower than the motor 20.

Referring to FIG. 2 and FIG. 3, in the first embodiment of the present invention, the wall-mounted fan may be used outdoors and locked to the wall. When it is raining, because the connecting portion 122 of the main housing 12 is fitted on the outer wall of the secondary housing 13 and the housing 10 and the accommodation space 11 of the housing 10 are inclined downward from the main housing 12 toward the secondary housing 13, the majority of the rainwater falls along the periphery of the housing 10 and the rainwater does not enter the accommodation space 11 of the housing 10 from the gap between the main housing 12 and the secondary housing 13. If the rainwater enters the accommodation space 11 of the housing 10 from the second secondary opening 132 of the secondary housing 13, the rainwater can be discharged from the first drain hole 40 so that the rainwater does not accumulate to the motor 20.

Figure 4:
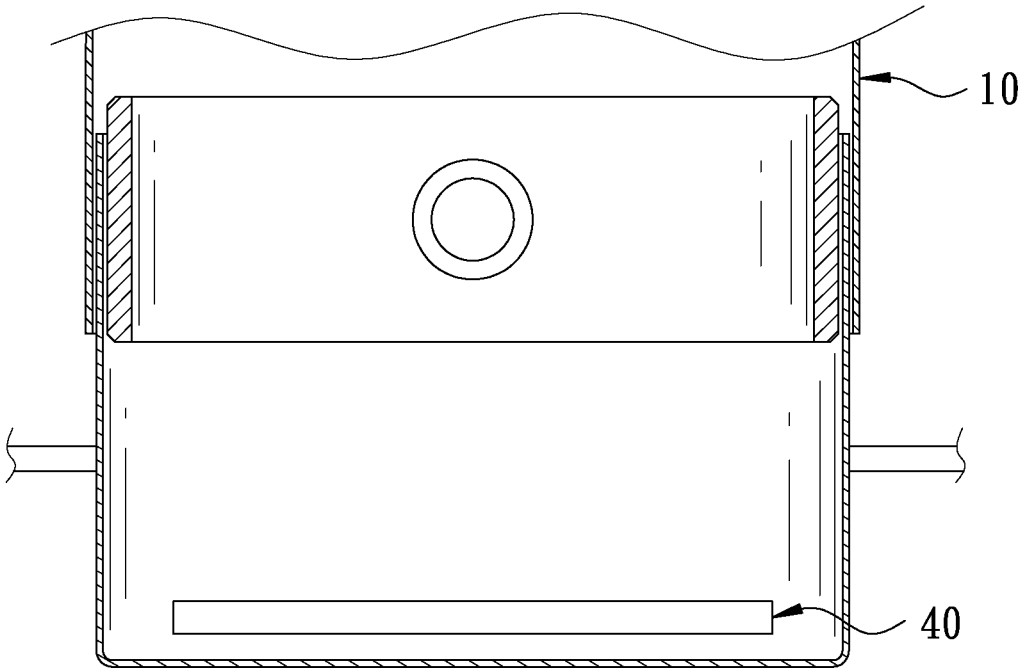
FIG. 4 is a partial enlarged sectional view in accordance with a second embodiment of the present invention.

FIG. 4 is a partial enlarged sectional view in accordance with a second embodiment of the present invention, which is different from the first embodiment in that the first drain hole 40 is an elongated hole and the first drain hole 40 is non-parallel to the axial direction of the housing 10. Through the inclination of the housing 10, the rainwater can be discharged more easily.

Figure 5:
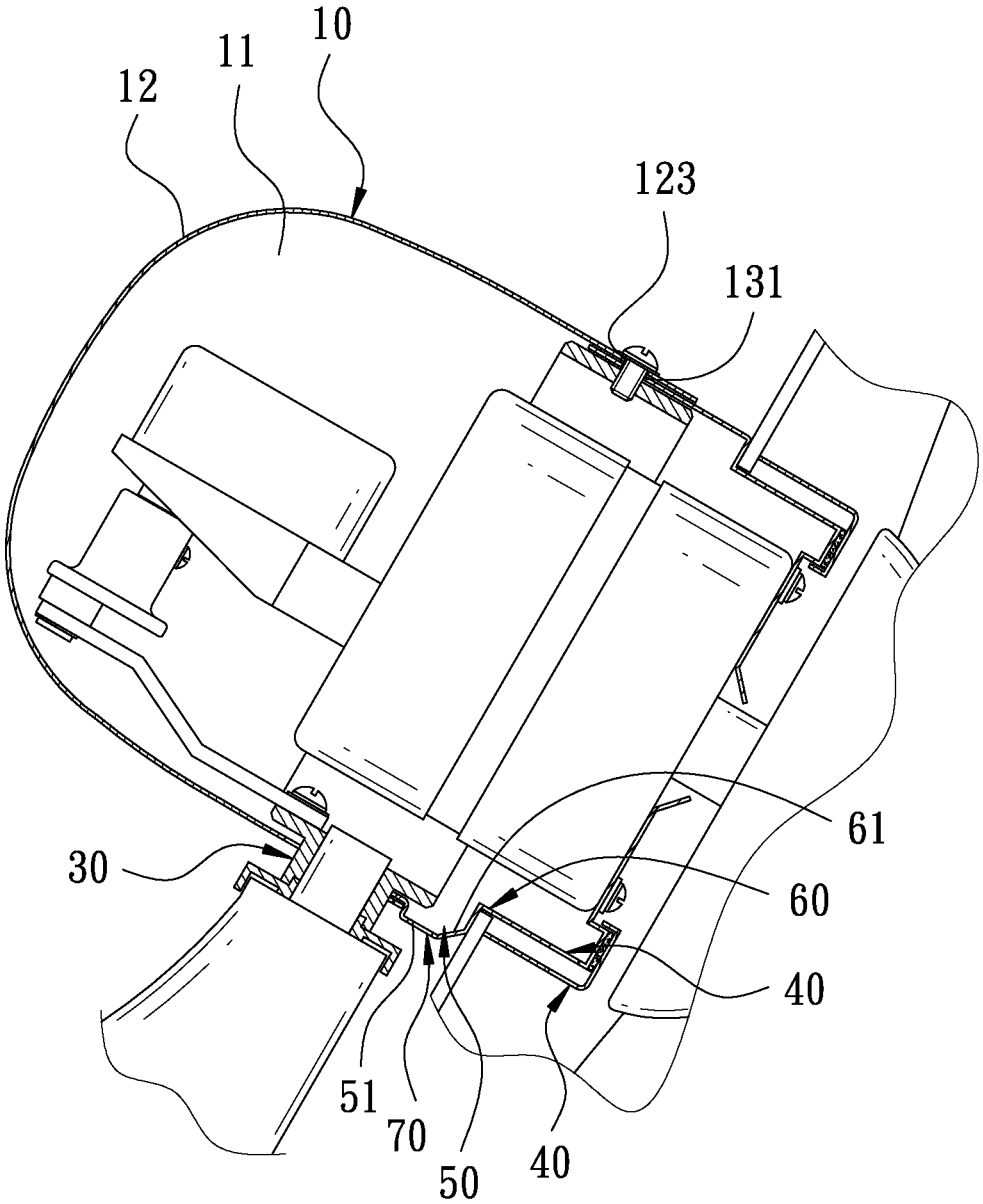
FIG. 5 is a schematic view in accordance with a third embodiment of the present invention when in use.
Figure 6:
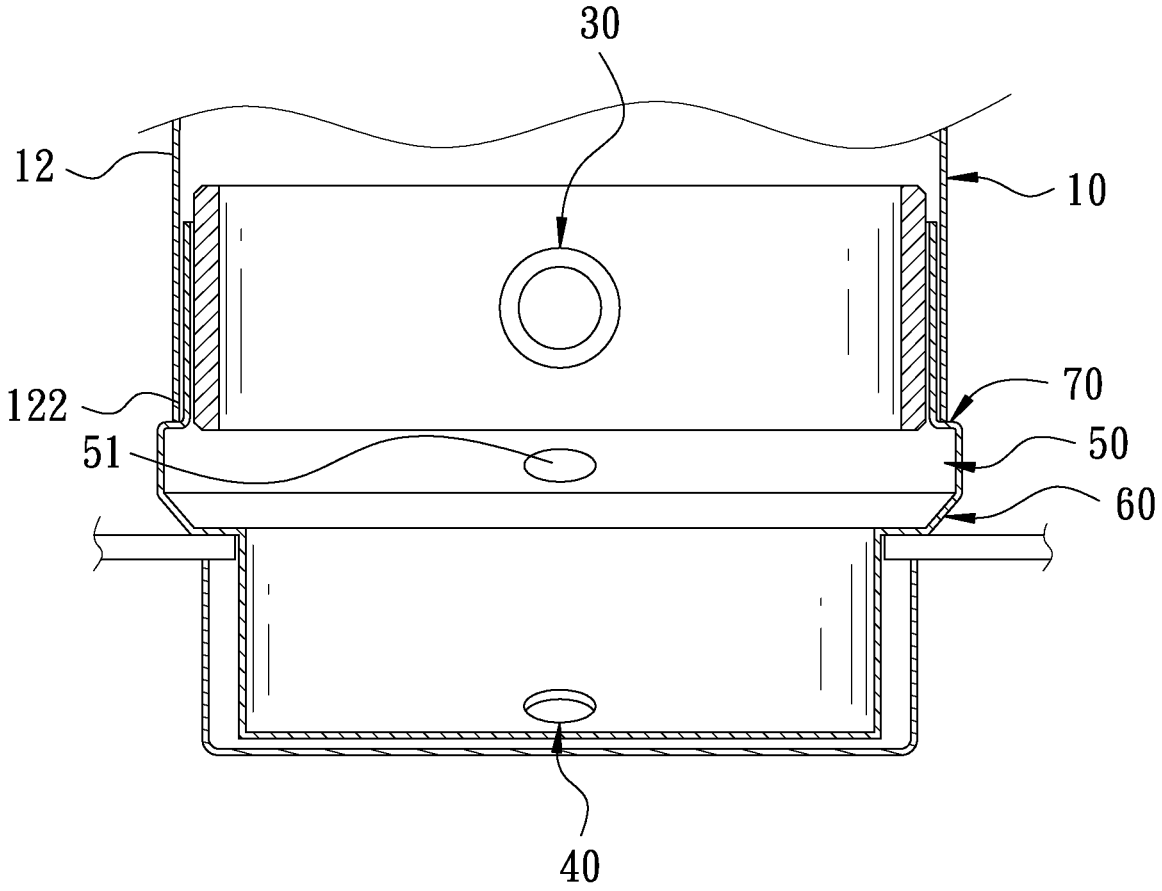
FIG. 6 is a partial enlarged sectional view in accordance with the third embodiment of the present invention.

FIG. 5 is a schematic view in accordance with a third embodiment of the present invention when in use. FIG. 6 is a partial enlarged sectional view in accordance with the third embodiment of the present invention. The third embodiment is substantially similar to the first embodiment with the exceptions described hereinafter. The secondary housing 13 has two first drain holes 40. The secondary housing 13 may be composed of at least one component. Wherein, the waterproof structure 100 of the wall-mounted fan housing further comprises a recess 50, a raised portion 60, and a flange 70.

The recess 50 is disposed in the accommodation space 11 of the housing 10. In this embodiment, the recess 50 is disposed in the accommodation space 11 of the housing 10. The recess 50 is located between the support rod 30 and the first drain hole 40. The recess 50 is non-parallel to the axial direction of the housing 10. Wherein, the recess 50 is provided with a second drain hole 51. The position of the second drain hole 51 is lower than the second secondary opening 132 of the secondary housing 13. Wherein, the recess 50 is an elongated recess. The recess 50 is disposed at the bottom of the secondary housing 13.

The raised portion 60 is disposed at the bottom of the accommodation space 11 of the housing 10. Wherein, the secondary housing 13 is provided with the raised portion 60. The raised portion 60 is located between the first drain hole 40 and the second drain hole 51. A guide slope 61 is provided between the raised portion 60 and the second drain hole 51. The position of the raised portion 60 is higher than the first drain hole 40 and the second drain hole 51.

The inner wall of the housing 10 is recessed outwardly to form the recess 50 so that the flange 70 is formed on the outer wall of the recess 50 of the housing 10. The flange 70 is disposed on the secondary housing 13 of the housing 10. The connecting portion 122 of the main housing 12 leans against the flange 70.

In the third embodiment of the present invention, when the housing 10 is assembled, the connecting portion 122 of the main housing 12 abuts against the flange 70 so that the screw hole 123 of the main housing 12 is aligned with the locking holes 131 of the secondary housing 13 more easily. When rainwater enters the accommodation space 11, since the raised portion 60 is disposed between the first drain hole 40 and the second drain hole 51, the rainwater is guided and diverted to the first drain hole 40 and the second drain hole 51. Besides, the recess 50 is located between the support rod 30 and the first drain hole 40, and the recess 50 is non-parallel to the axial direction of the housing 10, such that the rainwater is more likely to be collected in the recess 50 and is discharged from the second drain hole 51 to the outside of the housing 10.

Figure 7:
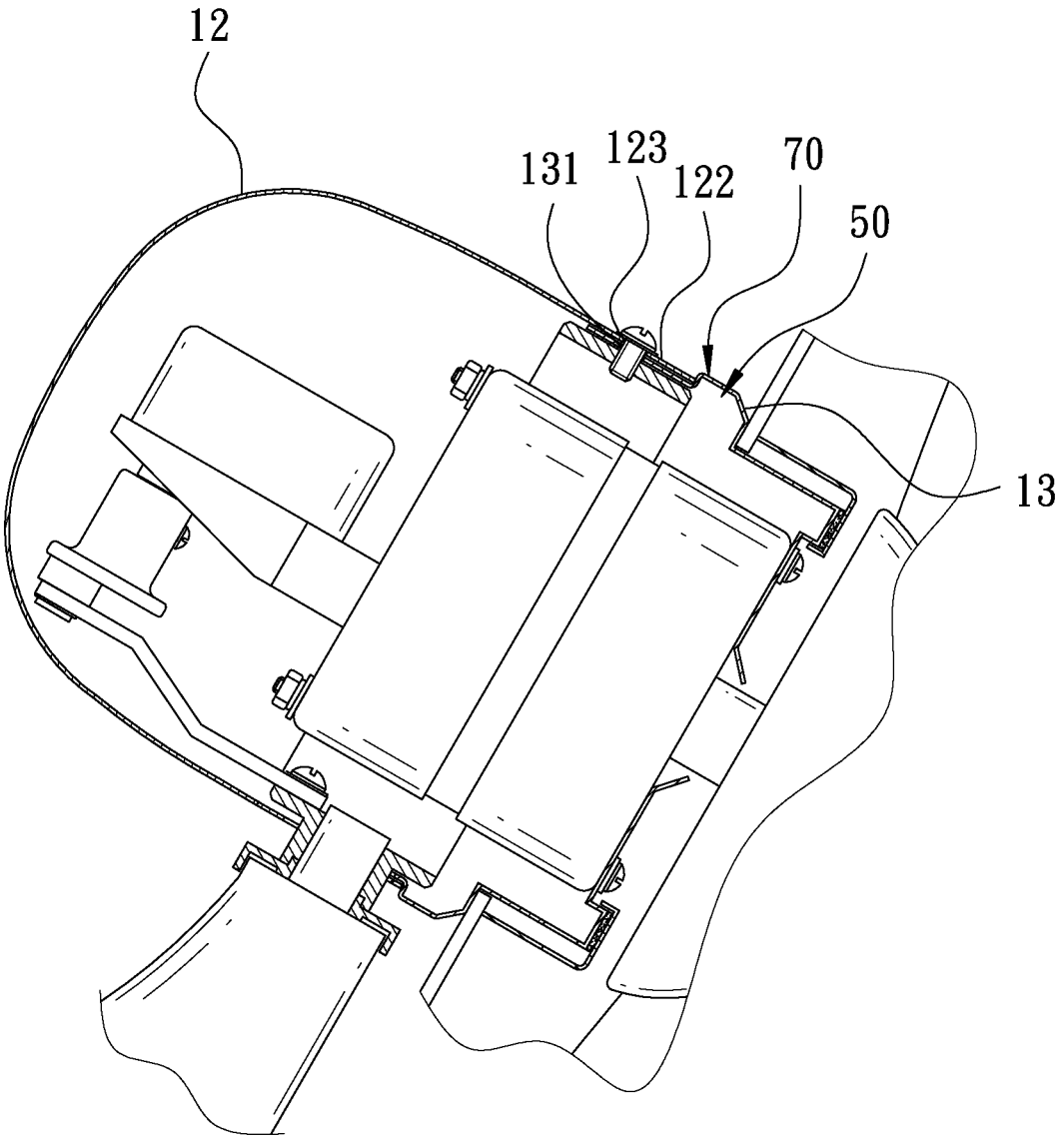
FIG. 7 is a schematic view in accordance with a fourth embodiment of the present invention when in use.
Figure 8:
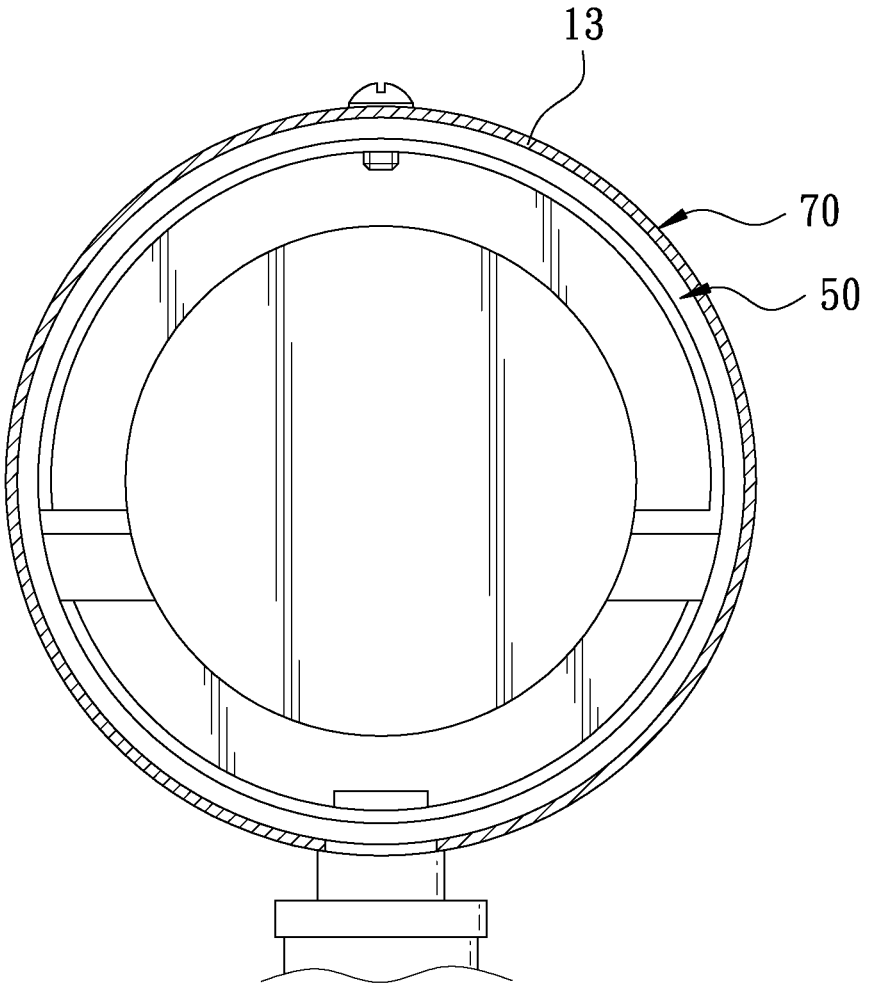
FIG. 8 is a partial enlarged sectional view in accordance with the fourth embodiment of the present invention.

FIG. 7 is a schematic view in accordance with a fourth embodiment of the present invention when in use. FIG. 8 is a partial enlarged sectional view in accordance with the fourth embodiment of the present invention. The fourth embodiment is substantially similar to the third embodiment with the exceptions described hereinafter. The recess 50 is annularly disposed in the secondary housing 13 to form an annular recess, thereby providing a better guide effect. The inner wall of the secondary housing 13 is recessed outwardly to form the recess 50 so that the flange 70 is formed on the outer wall of the recess 50 of the secondary housing 13. The flange 70 is an annular flange. Wherein, the connecting portion 122 of the main housing 12 leans against the flange 70. According to the fourth embodiment of the present invention, when the housing 10 is assembled, the connecting portion 122 of the main housing 12 leans against the flange 70 so that the alignment of the screw hole 123 and the locking hole 131 is more stable compared to the third embodiment.

Figure 9:
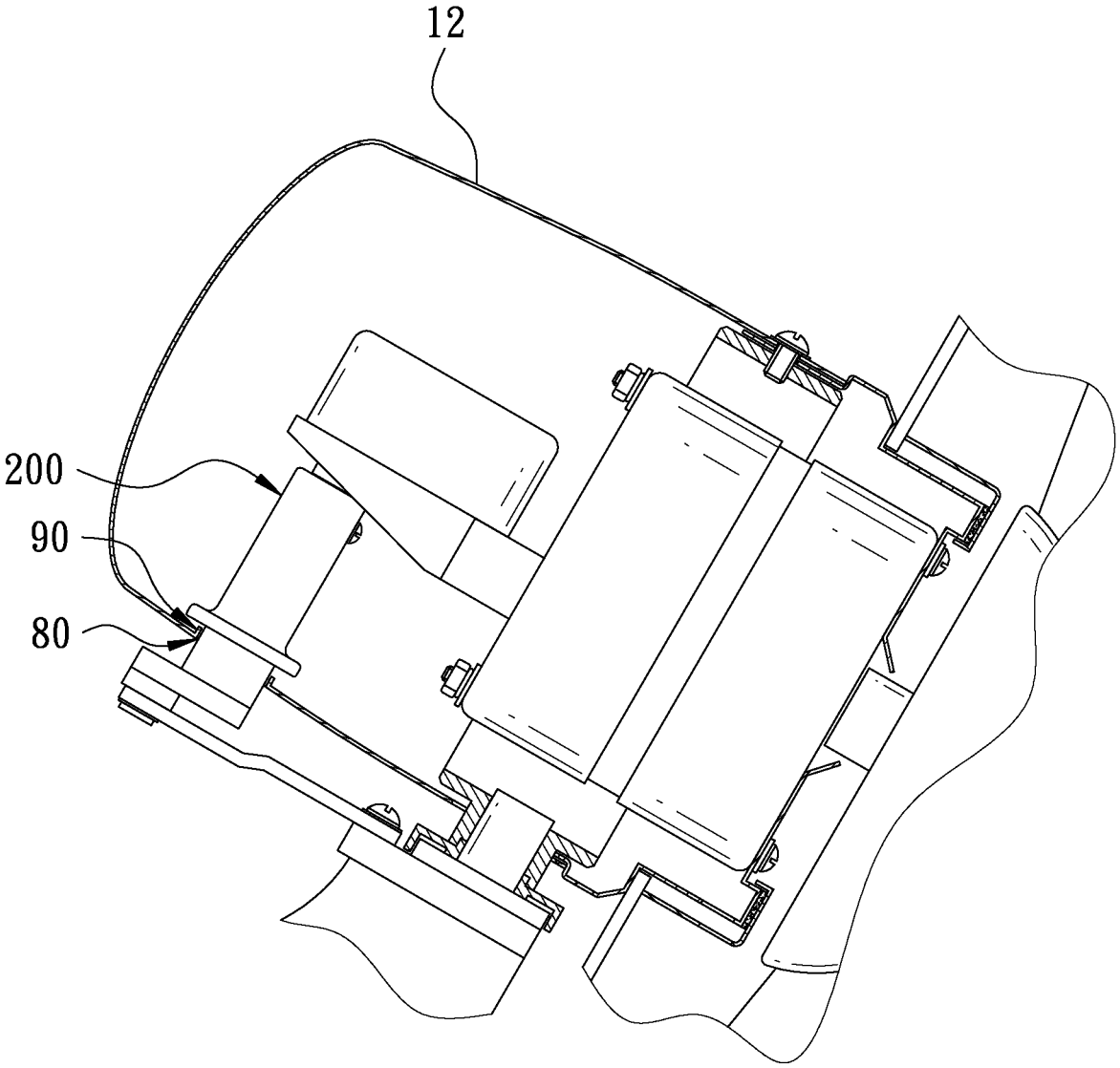
FIG. 9 is a schematic view in accordance with a fifth embodiment of the present invention when in use.

FIG. 9 is a schematic view in accordance with a fifth embodiment of the present invention when in use, which is different from the fourth embodiment in that the bottom of the main housing 12 is provided with a perforation 80. The main housing 12 is provided with a stop edge 90 extending inwardly from the periphery of the perforation 80. The stop edge 90 is annularly disposed around the periphery of the perforation 80. The perforation 80 is adapted for a swing device 200 to pass therethrough, such as a motor, a rotating shaft, a connecting rod, a drive shaft and the like of the swing device. The stop edge 90 is configured to block rainwater.

Figure 10:
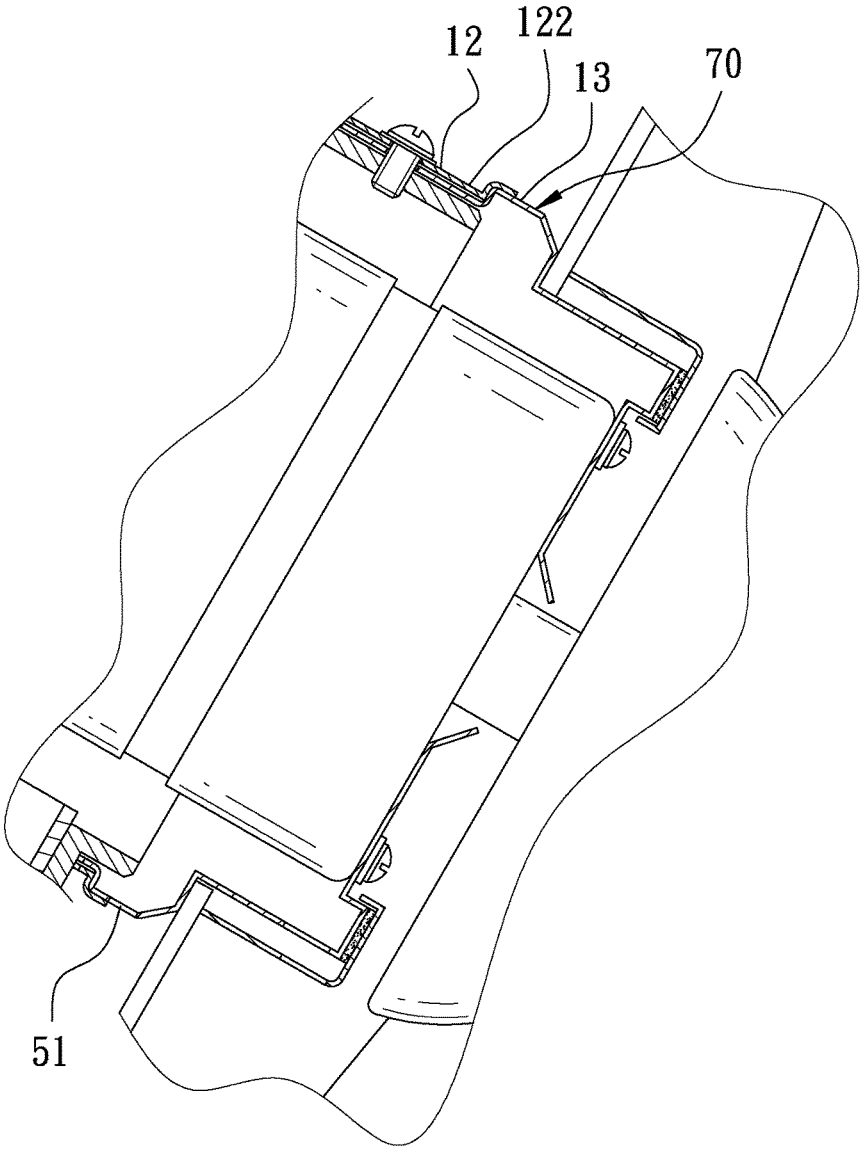
FIG. 10 is a schematic view in accordance with a sixth embodiment of the present invention when in use.

FIG. 10 is a schematic view in accordance with a sixth embodiment of the present invention when in use, which is different from the fifth embodiment in that the connecting portion 122 of the main housing 12 extends to the outer side of the flange 70 and does not shield the second drain hole 51. Through the extension of the connecting portion 122 of the main housing 12, in addition to increasing the shielding area, the gap between the main housing 12 and the secondary housing 13 is more curved so as to hinder rainwater from entering the housing 10.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A structure of a wall-mounted fan housing, comprising:

a housing, having an accommodation space therein, the housing having a main housing and a secondary housing, one side of the main housing having a main opening, the main housing having a connecting portion around a periphery of the main opening, one side of the secondary housing having a first secondary opening, the connecting portion of the main housing being fitted on an outer wall of the first secondary opening of the secondary housing, respective insides of the main housing and the secondary housing jointly forming the accommodation space, the housing and the accommodation space of the housing being inclined downward from the main housing toward the secondary housing, another side of the secondary housing having a second secondary opening;

a motor, disposed in the accommodation space of the housing, the motor having a rotating shaft, the rotating shaft extending toward the second secondary opening of the secondary housing;

a first drain hole, disposed at a bottom of the secondary housing close to the second secondary opening of the secondary housing, the first drain hole being lower than the motor;

a support rod disposed at a bottom of the housing; and a recess disposed in the accommodation space of the housing, the recess being located between the support rod and the first drain hole, the recess being non-parallel to an axial direction of the housing, the recess being provided with a second drain hole, the second drain hole being lower than the second secondary opening of the secondary housing.

2. The structure of the wall-mounted fan housing as claimed in claim 1, wherein the support rod penetrates through the main housing and the secondary housing, and the support rod is located under the motor.

3. The structure of the wall-mounted fan housing as claimed in claim 1, wherein the recess is an elongated recess, and the recess is disposed at the bottom of the secondary housing.

4. The structure of the wall-mounted fan housing as claimed in claim 1, wherein the recess is annularly disposed in the secondary housing.

5. The structure of the wall-mounted fan housing as claimed in claim 1, further comprising a raised portion disposed at a bottom of the accommodation space of the housing, the raised portion being located between the first drain hole and the second drain hole, a guide slope being provided between the raised portion and the second drain hole.

6. The structure of the wall-mounted fan housing as claimed in claim 5, wherein the secondary housing is provided with the raised portion, and the raised portion is higher than the first drain hole and the second drain hole.

7. The structure of the wall-mounted fan housing as claimed in claim 1, further comprising a flange, an inner wall of the housing being recessed outwardly to form the recess so that the flange is formed on an outer wall of the recess of the housing.

8. The structure of the wall-mounted fan housing as claimed in claim 7, wherein the connecting portion of the main housing extends to an outer side of the flange and does not shield the second drain hole.

9. The structure of the wall-mounted fan housing as claimed in claim 7, wherein the flange is disposed on the secondary housing of the housing, the connecting portion of the main housing leans against the flange, the connecting portion of the main housing is provided with a screw hole, and the secondary housing is provided with a locking hole corresponding to the screw hole.

10. The structure of the wall-mounted fan housing as claimed in claim 1, wherein a bottom of the main housing is provided with a perforation, the main housing is provided with a stop edge extending inwardly from a periphery of the perforation, the stop edge is annularly disposed around the periphery of the perforation, the perforation is adapted for a swing device to pass therethrough.

11. The structure of the wall-mounted fan housing as claimed in claim 1, wherein the motor is spaced a distance from an inner wall of the housing.

12. The structure of the wall-mounted fan housing as claimed in claim 1, wherein the first drain hole is an elongated hole.

13. The structure of the wall-mounted fan housing as claimed in claim 1, wherein the first drain hole is non-parallel to an axial direction of the housing.

14. The structure of the wall-mounted fan housing as claimed in claim 1, wherein the housing has a circular curve shape.

15. The structure of the wall-mounted fan housing as claimed in claim 1, wherein an outer wall of the secondary housing, adjacent to the second secondary opening, is provided with an extension portion around the second secondary opening, and the extension portion is tapered outwardly.

* * * * *